US010569566B2

(12) United States Patent
Hart et al.

(10) Patent No.: US 10,569,566 B2
(45) Date of Patent: Feb. 25, 2020

(54) PRINTER AND METHOD

(71) Applicant: VIDEOJET TECHNOLOGIES INC., Wood Dale, IL (US)

(72) Inventors: Philip Hart, Nottingham (GB); Jeremy Ellis, Nottinghamshire (GB)

(73) Assignee: VIDEOJET TECHNOLOGIES INC., Wood Dale, IL (US)

( * ) Notice: Subject to any disclaimer, the term of this patent is extended or adjusted under 35 U.S.C. 154(b) by 103 days.

(21) Appl. No.: 15/523,523

(22) PCT Filed: Nov. 2, 2015

(86) PCT No.: PCT/GB2015/053289
§ 371 (c)(1),
(2) Date: May 1, 2017

(87) PCT Pub. No.: WO2016/067055
PCT Pub. Date: May 6, 2016

(65) Prior Publication Data

US 2017/0305171 A1 Oct. 26, 2017

(30) Foreign Application Priority Data

Oct. 31, 2014 (GB) ..... 1419463.3

(51) Int. Cl.
*B41J 2/325* (2006.01)

(52) U.S. Cl.
CPC ..... *B41J 2/325* (2013.01)

(58) Field of Classification Search
CPC ..... B41J 2/325; B41J 2/355
See application file for complete search history.

(56) References Cited

U.S. PATENT DOCUMENTS

| | | | | |
|---|---|---|---|---|
| 4,067,017 | A | 1/1978 | Dertouzos et al. | |
| 5,193,007 | A * | 3/1993 | Yokoyama | B41J 17/08 347/215 |
| 5,481,291 | A | 1/1996 | Ishida et al. | |
| 5,701,150 | A | 12/1997 | Horemans et al. | |
| 2007/0019061 | A1 | 1/2007 | Koyabu et al. | |
| 2007/0019062 | A1 | 1/2007 | Koyabu et al. | |

FOREIGN PATENT DOCUMENTS

| | | | |
|---|---|---|---|
| EP | 0360282 | A2 | 3/1990 |
| EP | 2497644 | A1 | 9/2012 |
| JP | S6255164 | A | 3/1987 |

(Continued)

*Primary Examiner* — Huan H Tran
(74) *Attorney, Agent, or Firm* — Beusse, Wolter, Sanks & Maire PLLC; Robert L. Wolter

(57) ABSTRACT

A method of operating a thermal transfer printer, the thermal transfer printer comprising: first and second spool supports each being configured to support a spool of ribbon; a ribbon drive configured to cause movement of ribbon from the first spool support to the second spool support along a predetermined ribbon path; and a printhead, the printhead being a corner edge printhead. The printhead is configured to selectively transfer ink from the ribbon to a substrate as the substrate and printhead are moved relative to one another at a print speed. The method comprises transferring ink from the ribbon to the substrate when the print speed is less than 40 millimetres per second.

4 Claims, 8 Drawing Sheets

(56) References Cited

FOREIGN PATENT DOCUMENTS

| | | | | |
|---|---|---|---|---|
| JP | S62279964 | A | | 12/1987 |
| JP | H01278375 | A | | 11/1989 |
| JP | H11334129 | A | | 12/1999 |
| JP | 2005040971 | A | * | 2/2005 |
| JP | 2005040971 | A | | 2/2005 |
| JP | 2005313481 | A | | 11/2005 |
| WO | 2006085888 | A2 | | 8/2006 |

* cited by examiner

Cont_1

Cont_2

Cont_3

Cont_4

Cont_5

PRINTER AND METHOD

The present invention relates to printing and more particularly to a thermal transfer printer and a method for controlling such a printer.

Thermal transfer printers use an ink carrying ribbon. In a printing operation, ink carried on the ribbon is transferred to a substrate which is to be printed. To effect the transfer of ink, the printhead is brought into contact with the ribbon, and the ribbon is brought into contact with the substrate. The printhead contains printing elements which, when heated, whilst in contact with the ribbon, cause ink to be transferred from the ribbon and onto the substrate. Ink will be transferred from regions of the ribbon which are adjacent to printing elements which are heated. An image can be printed on a substrate by selectively heating printing elements which correspond to regions of the image which require ink to be transferred, and not heating printing elements which correspond to regions of the image which require no ink to be transferred.

The printing elements are generally arranged in a linear array. By causing relative movement between the printhead and the substrate on which printing is to occur, an image can be printed by carrying out a series of printing operations, each printing operation comprising the energisation of none, some or all of the printing elements to print a 'line' of the desired image before the relative movement is caused. A further 'line' is then printed in a next printing operation. A plurality of lines printed in this way together form the whole of the desired image.

In known printing methods the relative speed of movement between the printhead and the substrate on which printing is to occur is generally above a minimum print speed. For example, where printing is carried out in an arrangement in which the substrate is not stationary with respect to the printhead, then the substrate is generally moved at least a minimum print speed. However, on a processing line, it is not uncommon for a substrate to be caused to stop at an arbitrary time, which may be during a partially completed printing cycle. Where such an event occurs, it may be necessary to stop printing while the substrate is decelerated from the normal print speed to a stopped state. However, it will be appreciated that while the substrate is decelerated, it will still move relative to the printhead. Where the substrate is moving below the minimum print speed, printing will be deactivated. As such, when printing resumes, it may be necessary to reverse the substrate, such that printing can resume at the point at which it was deactivated. Further, it may be necessitate to reverse the substrate beyond the point at which printing was deactivated, so as to allow the substrate to be accelerated up to the minimum print speed prior to the resumption of printing. It will be appreciated that in any such method, the substrate must be positioned with a high level of accuracy to enable printing to resume at the exact location it was terminated, so as to generate a continuous image.

Alternatively, any printed image which was stopped during a printing cycle may be abandoned. However, this can lead to unacceptable levels of waste.

It is an object of some embodiments of the invention to provide a novel control method for a thermal printhead which obviates or mitigates some of the problems outlined above.

According to a first aspect of the invention there is provided a method of operating a thermal transfer printer, the thermal transfer printer comprising: first and second spool supports each being configured to support a spool of ribbon; a ribbon drive configured to cause movement of ribbon from the first spool support to the second spool support along a predetermined ribbon path; and a printhead, the printhead being configured to selectively transfer ink from the ribbon to a substrate as the substrate and printhead are moved relative to one another at a print speed; the method comprising transferring ink from the ribbon to the substrate when the print speed is less than 40 millimetres per second.

By providing a printing method which is able to operate at speeds of below 40 mm/s, printing can be carried out on a substrate as it is moved at a wide range of speeds, for example during acceleration or deceleration. That is, when a substrate is stopped, printing can be carried out as the substrate decelerates, ensuring that printing can be carried out at all points of the movement of the substrate past the printhead.

The print speed may be less than 30 millimetres per second, less than 20 millimetres per second or less than 10 millimetres per second. It is preferable that the print speed is variable so to be able to adopt any speed which is less than 40 millimetres per second by appropriate control of the ribbon drive. For example printing may be possible at speeds of about 1 millimetre per second.

The printhead may be a corner edge printhead. A corner edge printhead may also be referred to as a near edge printhead. In a corner edge or near edge printhead, the printing elements are arranged so as to be immediately adjacent to an edge or corner of the printhead. During printing, the printhead may be arranged so as to contact the printing surface at a predetermined angle, which may, for example, suitably be around 26°. Corner edge or near edge printheads can be contrasted with flat printheads, in which the printing elements are arranged so as to be on a flat surface of the printhead away from any edge or corner of the printhead, and in which the body of the printhead is arranged substantially parallel to the printing surface during printing. Corner or near edge printheads are further contrasted with true edge printheads, in which the printing elements are arranged so as to be on an end surface of the printhead, the body of the printhead extending away from the printing surface during printing in a direction substantially normal to the printing surface.

The use of corner edge printheads is known to allow high speed printing operations to be achieved. That is, print speeds of several hundred millimetres per second can be achieved. However, it has been realised that it is particularly advantageous to provide a printing method in which a printer having a corner edge printhead can be controlled to print both at high speeds and at slow speeds.

The method may comprise: generating a printing control signal for controlling the printhead, the printing control signal comprising one or more timing signals controlling one or more times for which one or more printing elements are energised in a printing operation.

Generating a first one of the one or more timing signals may comprise generating a number of pulses, the number being greater than or equal to one and being based upon the print speed, and wherein the total duration of said pulses defines a time for which said one or more printing elements are energised.

The method may comprise: obtaining the print speed during a printing operation; generating a printing control signal for controlling the printhead, the printing control signal comprising one or more timing signals controlling one or more times for which one or more printing elements are energised in said printing operation based upon the print speed; obtaining an updated print speed during said printing operation; generating a further printing control signal for controlling the printhead, the further printing control signal comprising one or more timing signals controlling one or more times for which one or more printing elements are energised in said printing operation based upon the updated print speed.

These features may be used in combination with features of the second and third aspects of the invention, as described in more detail below.

According to a second aspect of the invention there is provided a method of operating a thermal transfer printer, the thermal transfer printer comprising: first and second spool supports each being configured to support a spool of ribbon; a ribbon drive configured to cause movement of ribbon from the first spool support to the second spool support along a predetermined ribbon path; and a printhead, the printhead being configured to selectively transfer ink from the ribbon to a substrate as the substrate and printhead are moved relative to one another at a print speed, the method comprising: generating a printing control signal for controlling the printhead, the printing control signal comprising one or more timing signals controlling one or more times for which one or more printing elements are energised in a printing operation; wherein generating a first one of the one or more timing signals comprises generating a number of pulses, the number being greater than or equal to one, and wherein the total duration of said pulses defines a time for which said one or more printing elements are energised. The number of pulses may be based upon the print speed. The length of at least some of the or each pulse may be based upon the print speed.

By pulsing the timing signals it is possible to distribute the energy delivered to a printing element throughout a printing operation, allowing ink to be melted, and maintained in a molten state throughout the printing operation, without overheating the printing element, and thus reducing the risk of damage to the printing element of ribbon. Pulsing may be particularly beneficial at slow printing speeds, as such, the number of pulses can be adjusted to optimise the delivery of energy to printing elements as required.

Generating a number of pulses may comprise: when the print speed is less than a first predetermined threshold, generating a plurality of pulses the total duration of which pulses define the time for which said one or more printing elements are energised; and when the print speed is greater than or equal to the first predetermined threshold, generating a single pulse the duration of which defines the time for which said one or more printing elements are energised.

The plurality of pulses may be distributed within the duration of said printing operation. By distributed within a printing the duration of a printing operation it is meant that the pulses are not concentrated within a small portion of the duration of the printing operation, but rather are distributed throughout the entire duration of the printing operation (albeit not necessarily equally), allowing energy to be gradually supplied to printing elements, rather than delivered in a single large burst.

The method may comprise determining the time for which said one or more printing elements are energised in said printing operation based upon the print speed.

Generating a second one of the one or more timing signals may comprise, when the print speed is less than a second predetermined threshold, generating a plurality of pulses the total duration of which pulses define the time for which said one or more printing elements are energised; and when the print speed is greater than or equal to the second predetermined threshold, generating a single pulse the duration of which defines the time for which said one or more printing elements are energised.

The second predetermined threshold may be lower than the first predetermined threshold.

According to a third aspect of the invention there is provided a method of operating a thermal transfer printer, the thermal transfer printer comprising: first and second spool supports each being configured to support a spool of ribbon; a ribbon drive configured to cause movement of ribbon from the first spool support to the second spool support along a predetermined ribbon path; and a printhead, the printhead being configured to selectively transfer ink from the ribbon to a substrate as the substrate and printhead are moved relative to one another at a print speed, the method comprising: obtaining a print speed during a printing operation; generating a printing control signal for controlling the printhead, the printing control signal comprising one or more timing signals controlling one or more times for which one or more printing elements are energised in said printing operation based upon the print speed; obtaining an updated print speed during said printing operation; generating a further printing control signal for controlling the printhead, the further printing control signal comprising one or more timing signals controlling one or more times for which said one or more printing elements are energised in said printing operation based upon the updated print speed.

As print speed varies, the optimal printing control signals (e.g. timing and number of pulses) may also vary. As such, by updating the printing control signals during a printing operation (that is, during the printing of a single line), based on the print speed, optimal print signals can be delivered to the printhead at all times. This is particularly beneficial at low printing speeds, where the proportional change in print speed during a single printing operation can be significant.

Generating a printing control signal may comprise: obtaining first data indicating a relationship between the print speed and at least one property of at least one of said one or more timing signals; and generating said one or more timing signals based upon said first data.

Said property may comprise a total duration of the at least one timing signal. The total duration of the at least one timing signal may be a portion of a duration of said printing operation.

Said property may comprise a number of pulses, the at least one timing signal comprising said number of pulses, the total duration of which pulses defines a time for which said one or more printing elements are energised. Said property may comprise a time for which said one or more printing elements are energised.

Generating a further printing control signal may comprise obtaining further data indicating a relationship between the print speed and a property of at least one of said one or more timing signals; and generating said one or more timing signals based upon said further data.

When a predetermined criterion is satisfied, each of the one or more timing signals may have the same duration. The predetermined criterion may be a predetermined period of time having elapsed since a previous printing operation.

The print speed may be less than or equal to 40 mm/s. The print speed may be greater than or equal to 1 mm/s.

The printhead may comprise a printhead controller, and the method may further comprise, at the printhead controller, for each of a plurality of printing elements to be energised, determining a printing element control signal based upon energisation of one or more printing elements in a printing operation which precedes the subsequent printing operation.

Said determining a printing element control signal based upon energisation of one or more printing elements in a printing operation which precedes the subsequent printing operation may comprise selecting one of the one or more timing signals for each printing element to be energised based upon energisation of one or more printing elements in a printing operation which precedes the subsequent printing operation.

Features discussed above in the context of the second and third aspects of the invention can be applied to the first aspect of the invention.

The invention further provides a thermal printer controller comprising circuitry arranged to control a thermal printer to carry out a method as described above. The circuitry may comprise a memory storing processor readable instructions and a processor configured to read and execute instructions stored in said memory, the instructions being arranged to carry out the method described above.

A further aspect of the invention provides a thermal transfer printer comprising: first and second spool supports each being configured to support a spool of ribbon; and a ribbon drive configured to cause movement of ribbon from the first spool support to the second spool support; a printhead configured to selectively transfer ink from the ribbon to a substrate, and a controller of the type described in the preceding paragraph.

The invention also provides a thermal printer in which the printhead is arranged such that its constituent printing elements cause a thermally sensitive substrate to be heated.

The methods described above can be implemented in any convenient form. As such the invention also provides computer programs which can be executed by a processor of a thermal printer so as to cause a printhead of the thermal printer to be controlled in the manner described above. Such computer programs can be stored on computer readable media such as non-tangible, not transitory computer readable media.

Embodiments of the invention will now be described, by way of example only, with reference to the accompanying drawings in which.

Figure 1:
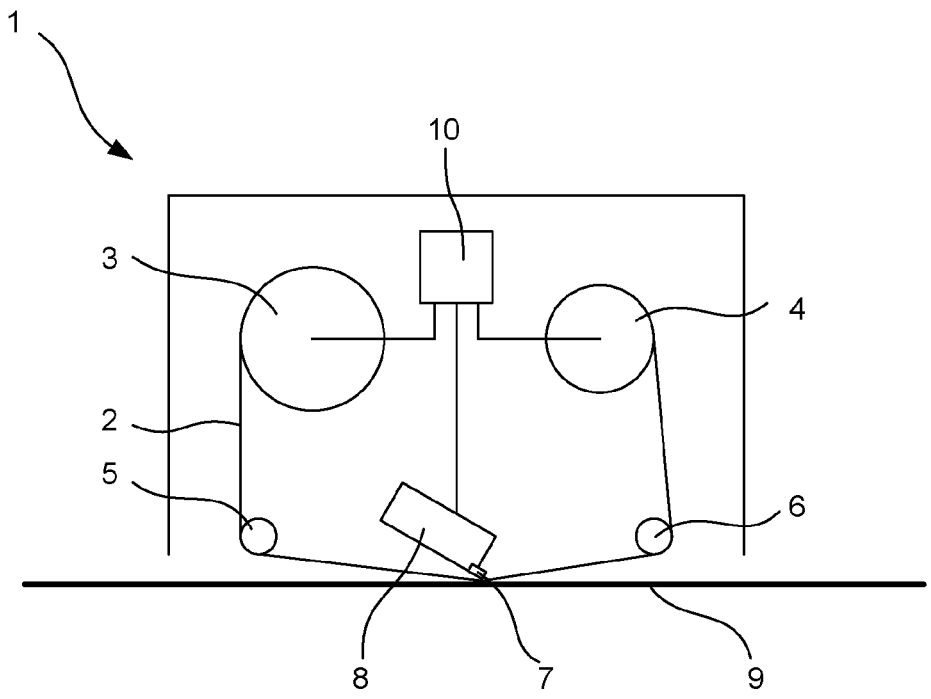
FIG. 1 is a schematic illustration of a thermal transfer printer in which embodiments of the invention may be implemented.

Referring to FIG. 1, a thermal transfer printer 1 comprises an ink carrying ribbon 2 which extends between two spools, a supply spool 3 and a takeup spool 4. In use, ribbon 2 is transferred from the supply spool 3 to the takeup spool 4 around rollers 5, 6, past a thermal printhead 7. The rollers 5, 6 may be idler rollers, and serve to guide the ribbon 2 along a predetermined path. The printhead 7 is mounted on a printhead carriage 8. The ribbon 2 is driven between the supply spool 3 and the takeup spool 4 under the control of a printer controller 10. The ribbon 2 may be transported between the supply spool 3 and the takeup spool 4 in any convenient way. One method for transferring ribbon is described in our earlier patent, US Pat. No. 7,150,572, the contents of which are herein incorporated by reference.

In a printing operation, ink carried on the ribbon 2 is transferred to a substrate 9 which is to be printed on. To effect the transfer of ink, the print head 7 is brought into contact with the ribbon 2. The ribbon 2 is also brought into contact with the substrate 9. The printhead 7 may be caused to move towards the ribbon 2 by movement of the printhead carriage 8, under control of the printer controller 10. The printhead 7 comprises printing elements 11 arranged in a one-dimensional linear array, which, when heated, whilst in contact with the ribbon 2, cause ink to be transferred from the ribbon 2 and onto the substrate 9. Ink will be transferred from regions of the ribbon 2 which correspond to (i.e. are aligned with) printing elements 11 which are heated. The array of printing elements 11 can be used to effect printing of an image on a substrate by selectively heating printing elements 11 which correspond to regions of the image which require ink to be transferred, and not heating printing elements 11 which require no ink to be transferred. Printing elements and regions of the printed image may be referred to as pixels.

A two dimensional image may be printed by printing a series of lines, the printing of each line being referred to as a printing operation. Different printing elements within the array may be heated during the printing of each line (i.e. during each printing operation). Between the printing of each line, the printhead 7, ribbon 2, and substrate 9 are moved with respect to each other, such that the line printed on the substrate 9 from one printing operation is adjacent to the line printed by the next printing operation. In some embodiments this is achieved by moving the printhead 7 relative to the ribbon 2 and substrate 9 which remain stationary, while in other embodiments this is achieved by holding the printhead 7 stationary and moving the ribbon 2 and substrate 9 relative to the printhead 7.

A barcode may be printed on a substrate by printing multiple lines, each of which provides a cross section of the whole barcode. Alternatively, where the barcode is printed in an orientation whereby bars of the barcode run generally parallel to the linear array of printing elements, each printing operation will print part of a bar of the barcode or else correspond to white space between adjacent bars of the bar code. Barcodes which are printed in such a way that bars of the barcode are generally parallel to the linear array of printing elements are referred to as 'ladder barcodes'. The inventors have discovered that print quality of ladder barcodes is particularly susceptible to overheating of printing elements. The techniques described herein are intended to avoid printhead overheating. As such, the described techniques are useful in improving the print quality of ladder barcodes which is important given that barcodes are, of course, intend to be scanned by a scanning device and degradation of print quality can have an adverse impact on the accuracy with which barcodes can be read. That said, it will be appreciated that the techniques described herein are generally applicable and can be used to improve print quality of any image, particularly but not exclusively images including sizeable portions of continuous print (i.e. large 'black' areas).

In one embodiment, the printhead 7 comprises a one-dimensional linear array of 1280 printing elements 11. Each printing element 11 comprises a heating element and a switching arrangement capable of determining whether that printing element is energised in a particular printing operation.

The printhead 7 may, for example, be a type of printhead often referred to as a corner edge or near edge printhead. In corner edge printheads printing elements are typically arranged immediately adjacent to an edge, or peel-off point, around which the ribbon passes. During printing, a corner edge printhead may be arranged so as to contact the printing surface at a predetermined angle, which may, for example, suitably be around 26°. Ink which is to be transferred should be maintained in a molten state as the ribbon 2 passes the peel-off point.

On the other hand, in some printers a flat (or serial) printhead may also be used. Where a flat printhead is used, ink which is to be transferred should be allowed to solidify before the ribbon 2 passes a peel-off point (which is provided at a distance from the printing elements). In further alternative printers a true edge printhead may be used.

Figure 2A:
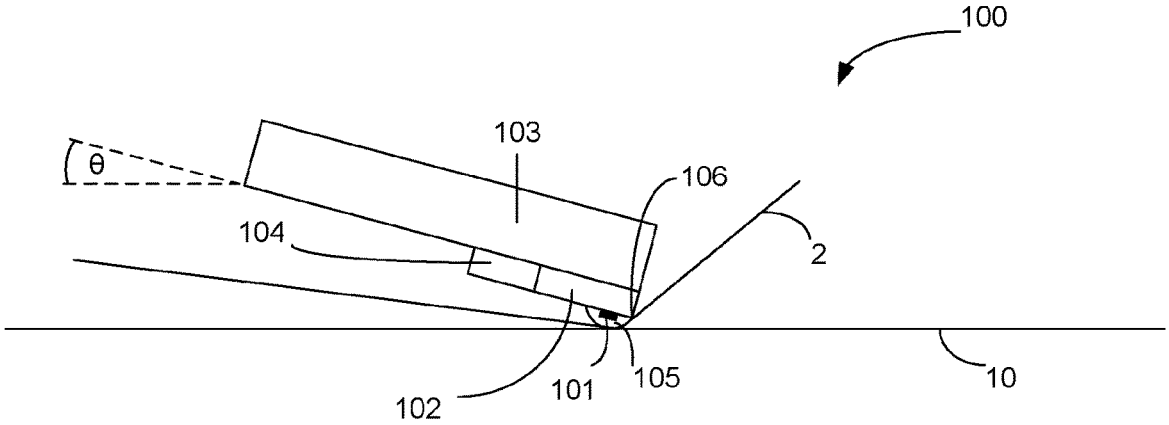
FIGS. 2A to 2C are schematic illustrations of thermal printheads in various known configurations.

FIG. 2A illustrates a corner edge printhead 100 in more detail. The corner edge printhead 100 comprises a plurality of thermal printing elements 101 arranged in a linear array extending into the surface of the page as shown. The thermal printing elements 101 are provided on a ceramic carrier 102 (which may be referred to as a ceramic, or ceramic wafer), which is itself mounted on a heat sink 103. The heat sink 103 may, for example, be formed from a metal such as aluminium and is arranged to provide a large thermal mass. The corner edge printhead 100 further comprises circuitry 104 which is arranged to provide control signals for the thermal printing elements 101 and may, for example, take the form of a flexible circuit which is bonded to the ceramic carrier 102. The corner edge printhead 100 further comprises a protective coating 105 which is provided over the thermal printing elements 101, and which is arranged to provide physical protection for printing elements 101 while also allowing thermal energy to flow from the printing elements 101 to the ribbon 2.

The printing elements 101 are provided adjacent to the edge of the ceramic carrier 102, and also adjacent to the edge of the heat sink 103. The corner edge printhead 100 is arranged such that the ceramic carrier 102 and heat sink 103 are disposed at a predetermined angle θ (e.g. 26° as described above) with respect to the surface of the substrate 10 during printing. Once the ribbon 2 has passed the printing elements 101 it is directed away from the substrate 10 by being pulled around a peel off point 106.

Figure 2B:
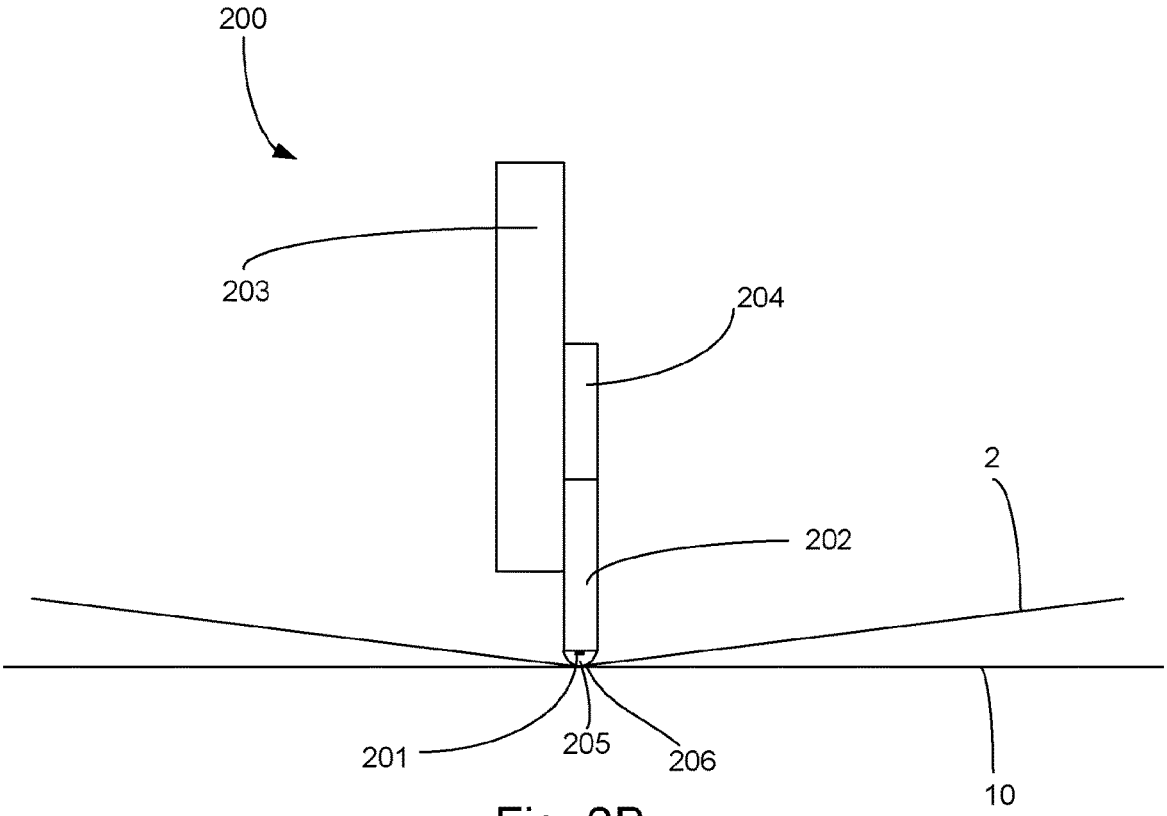

FIG. 2B illustrates a true edge printhead 200 in more detail. The true edge printhead 200 comprises a plurality of thermal printing elements 201 arranged in a linear array extending into the surface of the page as shown. The thermal printing elements 201 are provided on a ceramic carrier 202, which is itself mounted on a heat sink 203. The true edge printhead 200 further comprises circuitry 204 and a protective coating 205 which is provided over the thermal printing elements 201. The heat sink 203, circuitry 204, and protective coating 205 are generally of similar form and function to those described above with reference to the corner edge printhead 100. The protective coating 205 in a true edge printhead 200 is generally thicker than the equivalent coating 105 in a corner edge printhead 101. The thicker coating 205 provides improved protection of the printing elements 201 of true edge printheads, which are typically used for card printing.

The printing elements 201 are provided on an end surface of the ceramic carrier 202. The true edge printhead 200 is arranged such that the ceramic carrier 202 and heat sink 203 extend away from the substrate 10 during printing in a direction substantially normal to the surface of the substrate 10. The portion of the printhead 200 which is in contact with the ribbon 2 and substrate 10 during printing is limited to the thickness of the ceramic carrier 202. Once the ribbon 2 has passed the printing elements 201 it is directed away from the substrate 10 by being pulled around a peel off point 206, which is formed by a corner of the ceramic carrier 202. True edge printheads are generally considered to be suited to slow speed printing, particularly so given the thick coating 205 which is provided to protect the printing elements 201 and which acts to limit the rate at which heat from the printing elements 201 can be transmitted to the ribbon 2.

Figure 2C:
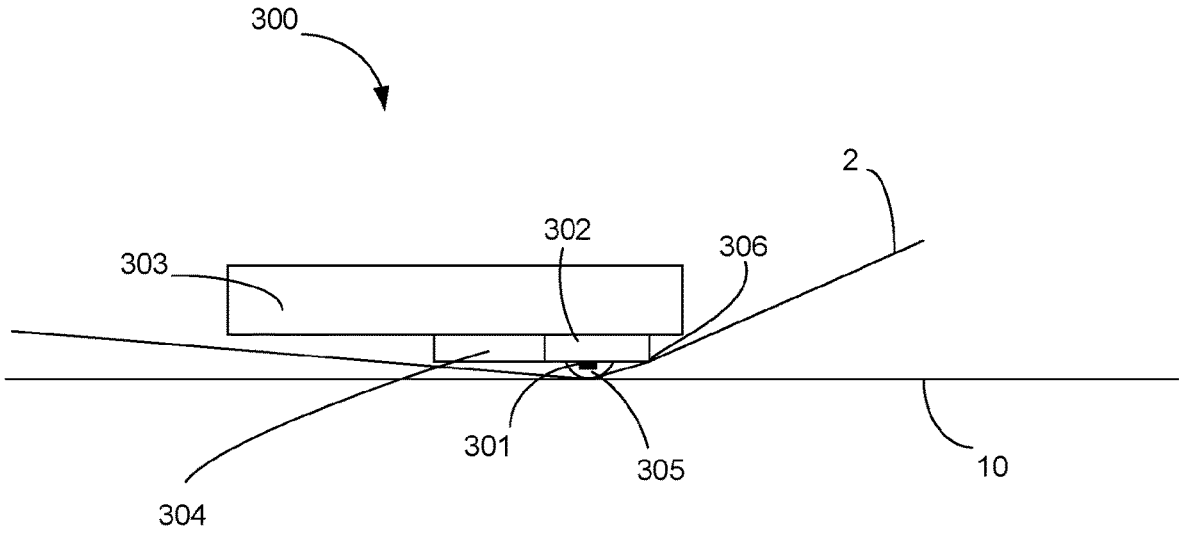

FIG. 2C illustrates a flat printhead 300 in more detail. The flat printhead 300 comprises a plurality of thermal printing elements 301 arranged in a linear array extending into the surface of the page as shown. The thermal printing elements 301 are provided on a ceramic carrier 302, which is itself mounted on a heat sink 303. The flat printhead 300 further comprises circuitry 304 and a protective coating 305 which is provided over the thermal printing elements 301. The heat sink 303, circuitry 304, and protective coating 305 are generally of similar form and function to those described above with reference to the corner edge printhead 100.

The printing elements 301 are provided on a flat surface of the ceramic carrier 302 spaced apart from either end of the ceramic carrier 302. The flat printhead 300 is arranged such that the ceramic carrier 302 and heat sink 303 are substantially parallel with the substrate 10 during printing. Once the ribbon 2 has passed the printing elements 301 it is directed away from the substrate 10 by being pulled around a peel off point 306, which is formed by a corner of the ceramic carrier 302. Given the spacing of the edge of the ceramic carrier 302 from the printing elements 301, it will be appreciated that ink heated by the printing elements 301 must travel the distance to the peel off point 306 before the ribbon 2 can be separated from the ink thereon.

It will be appreciated from the description above that corner edge or near edge printheads can be contrasted with flat printheads, by virtue of the fact that the spacing of the peel off point 106 from the printing elements 101 in a corner edge printhead 100, is significantly less than the spacing of the peel off point 306 from the printing elements 301 in a flat printhead 300. As such, ink heated by the printing elements 101 of a corner edge printhead 100 must travel a smaller distance before reaching the peel off point 106 than ink heated by printing elements 301 of a flat printhead 300 does before reaching the peel off point 306.

The use of corner edge printheads is known to allow high speed printing operations to be achieved. That is, print speeds of several hundred millimetres per second can be achieved. However, it has been realised that it is particularly advantageous to provide a printing method in which a printer having a corner edge printhead can be controlled to print both at high speeds and at slow speeds, as described in more detail below.

Figure 2D:
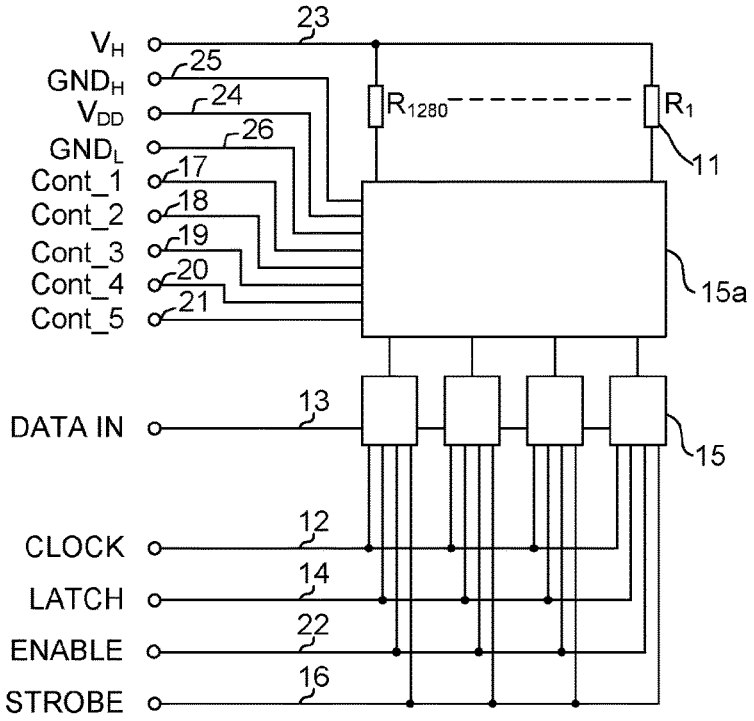
FIG. 2D is a schematic illustration of thermal printhead connections in the printer of FIG. 1.

Referring to FIG. 2D, connections to the printhead 7 are illustrated. The printhead 7 is an example of a corner edge printhead 100 as described above, the printing elements 11 being examples of printing elements 101. For ease of understanding only two printing elements 11 are illustrated, being one printing element at a first end of the one-dimensional linear array and one printing element at a second end of the one-dimensional linear array. It will be appreciated that the intermediate printing elements which are not shown in FIG. 2D take similar form and are similarly controlled. FIG. 2D also shows various printhead connections which are connected to and controlled by the printer controller 10.

Figure 3:
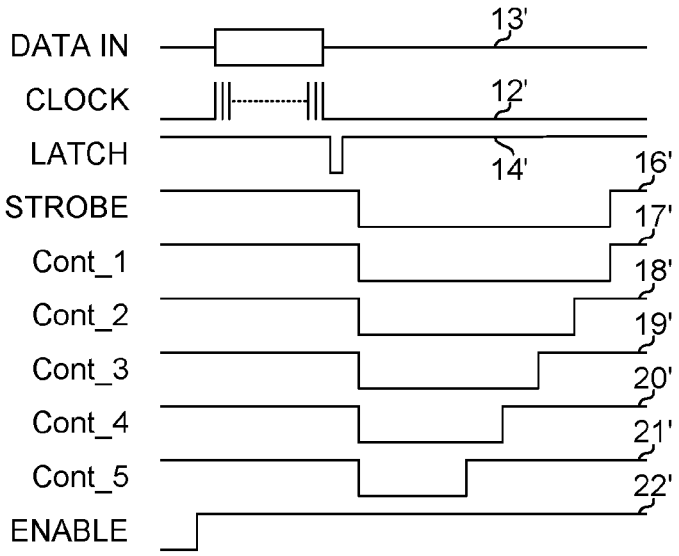
FIG. 3 is timing diagram showing signals provided on the connections of FIG. 2D.

FIG. 3 is a timing diagram showing signals provided on the various printhead connections shown in FIG. 2D by the printer controller 10 to effect printing. The connections shown in FIG. 2D and the signals provided on those connections as shown in FIG. 3 are now described together.

A clock signal 12' is provided on a clock line 12. Data 13' is provided on a data line 13 as serial binary data having 1280 bits, each bit of the data indicating whether a respective one of the 1280 printing elements is to be energised in a printing operation.

In one embodiment a '1' or high signal indicates that a respective printing element should be energised while a '0' or low signal indicates that the respective printing element should not be energised. The data line passes through registers provided by printing element controllers 15 which together provide a shift register. When 1280 bits of data have been received, a low latch signal 14' on an active-low latch line 14 causes the received data to be transferred from the registers provided by the printing element controllers 15 to control logic within the printing element controllers 15. The printing element controllers 15 can each control a single printing element or alternatively, as is the case in the described embodiment, a single printing element controller can control a plurality of printing elements. In the described embodiment the four printing element controllers 15 each control 320 printing elements, and therefore each receive 320 bits of data when the low latch signal 14' is provided on the latch line 14, each bit of data indicating whether one of the printing elements under the control of that printing element controller 15 should be energised.

During a printing operation a strobe signal 16' on an active-low strobe line 16 causes printing elements 11 to be energised. The duration of energisation is determined by the respective printing element controller 15 by selecting one of five active-low timing signals 17', 18', 19', 20', 21' respectively provided on a Cont_1 line 17, a Cont_2 line 18, a Cont_3 line 19, a Cont_4 line 20 and a Cont_5 line 21, the selected timing signal indicating the time for which a respective printing element should be energised. In this way the printing element controllers 15 can energise different ones of the printing elements 11 for different periods of time.

The printhead comprises an active-high enable line 22 on which a high signal 22' is provided for the duration of a printing operation.

In addition to the control signals described above the printhead also has two voltage connections 23, 24. A first voltage connection 23 provides a voltage supply to the printing elements 11. For example, the first voltage connection may be connected to a voltage of 24 volts. A second voltage connection 24 provides a voltage supply to the printing element controllers 15 and other elements of control logic within the printhead. Each of the first and second voltage connections 23, 24 is provided with a respective ground connection, a first ground connection 25 being associated with the first voltage connection 23 and a second ground connection 26 being associated with the second voltage connection 24.

The printhead further comprises control logic 15*a* to which are connected the control signals 17, 18, 19, 20, 21 and connections 24, 25, 26. The control logic 15*a* is connected by connections to the printing element controllers 15.

In operation, the printing element controllers 15 select a time for which a particular printing element should be energised by selecting between the timing signals provided on the lines 17, 18, 19, 20, 21. This selection is now described with reference to FIGS. 4A to 4E.

Where a printing element controller 15 is selecting an energisation time for a printing element A in a printing operation $P_n$, the printing element controller 15 has regard to energisation of the printing element A in the two immediately preceding printing operations $P_{n-1}$ and $P_{n-2}$. The printing element controller 15 also has regard to the energisation of spatially adjacent printing elements B, C in the immediately preceding printing operation $P_{n-1}$. Depending upon the energisations of the printing elements A, B, C in this way one of the timing signals 17', 18', 19', 20', 21' is selected.

FIGS. 4A to 4E all have common form. A three by three grid comprises one column for each of printing elements A, B, C as labelled. A central row labelled $P_{n-1}$ indicates whether the respective printing elements were energised in printing operation $P_{n-1}$. A top row labelled $P_{n-2}$ indicates whether the respective printing elements were energised in the printing operation $P_{n-2}$. Where a cross appears in a cell of the grid this indicates that the respective printing element was energised in the respective printing operation. Where a hollow circle appears in a cell of the grid this indicates that the respective printing element was not energised in the respective printing operation.

A bottom row of each grid relates to printing operation $P_n$, that being the printing operation for which the energisation time for the printing element A is being determined.

Figure 4A:
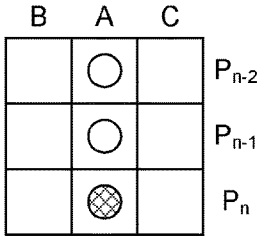
FIGS. 4A to 4E are schematic illustrations of an energy control scheme implemented in the printhead of FIG. 2D.

Referring first to FIG. 4A this indicates the pattern of energisations required to cause selection of the Cont_1 timing signal 17' provided on the Cont_1 line 17 for energisation of the printing element A in the printing operation $P_n$. This requires that in each of the printing operations $P_{n-1}$ and $P_{n-2}$ the printing element A was not energised. The Cont_1 signal is selected in this circumstance regardless of the energisation of the printing elements B, C in the printing operation $P_{n-1}$.

Figure 4B:
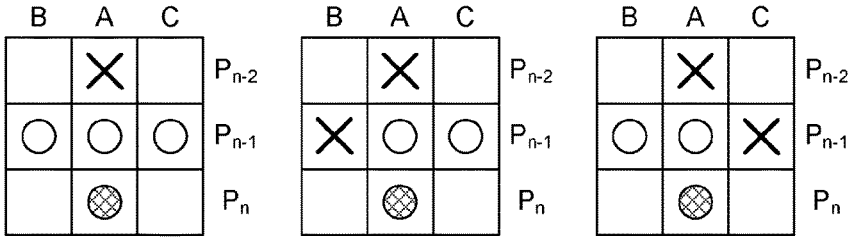

Referring to FIG. 4B, this indicates the pattern of energisations required to cause selection of the Cont_2 timing signal 18' provided on the Cont_2 line 18 for energisation of the printing element A in the printing operation $P_n$. Here, the requirement is that the printing element A was not energised in the printing operation $P_{n-1}$, that the printing element A was energised in the printing operation $P_{n-2}$, and that no more than one of the printing elements B, C was energised in the printing operation $P_{n-1}$.

Figure 4C:
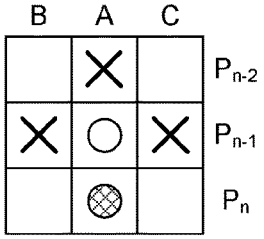

Referring to FIG. 4C, this indicates the pattern of energisations required to cause selection of the Cont_3 timing signal 19' provided on the Cont_3 line 19 for energisation of the printing element A in the printing operation $P_n$. Here, the requirement is that the printing element A was not energised in the printing operation $P_{n-1}$, that the printing element A was energised in the printing operation $P_{n-2}$, and that both of the printing elements B, C were energised in the printing operation $P_{n-1}$.

Figure 4D:
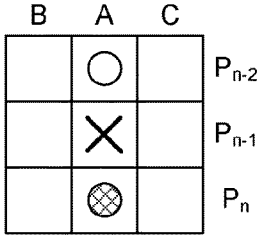

Referring to FIG. 4D, this indicates the pattern of energisations required to cause selection of the Cont_4 timing signal 20' provided on the Cont_4 line 20 for energisation of the printing element A in the printing operation $P_n$. Here, the requirement is that the printing element A was energised in the printing operation $P_{n-1}$, but was not energised in the printing operation $P_{n-2}$, regardless of the energisation of the printing elements B, C in the printing operation $P_{n-1}$.

Figure 4E:
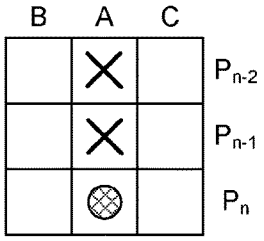

Referring to FIG. 4E, this indicates the pattern of energisations required to cause selection of the Cont_5 timing signal 21' provided on the Cont_5 line 21 for energisation of the printing element A in the printing operation $P_n$. Here, the requirement is that the printing element A was energised in the printing operation Pn-1, and was energised in the printing operation $P_{n-2}$, regardless of the energisation of the printing elements B, C in the printing operation $P_{n-1}$.

Referring back to FIG. 3 it can be seen that the time specified by the Cont_5 Signal 21' is the shortest of the timing signals while the Cont_1 signal 17' is the longest and the other timing signals form a range therebetween. From FIGS. 4A to 4E it can be seen that the Cont_5 signal 21' is selected when the printing element A has been energised in each of the immediately preceding printing operations. It can therefore be expected that in such a circumstance the printing element A will already be relatively hot thereby making a short energisation time, as specified by the Cont_5 signal 21', appropriate. Conversely, where the printing element A has not be energised in either of the immediately preceding operations it can be seen that the Cont_1 signal 17' is selected which will cause the relatively cool printing element to be heated for a relatively long time. Indeed, taken together, the illustrations of FIGS. 4A to 4E cause the time of energisation to be relatively long where the printing element A is relatively cool and relatively short where the printing element A is relatively hot.

As indicated above, the printer controller 10 controls the timing signals 17', 18', 19', 20', 21'. Processing carried out to determine the timing signals is described below. It can be noted, however, that in some embodiments the printer controller 10 may determine that two or more of the timing signals 17', 18', 19', 20', 21' should have the same value. In one embodiment the printer controller 10 is arranged to provide a signal on the Cont_1 line 17 which is of equal duration to the strobe signal 16'. This represents energisation of printing elements for a maximum possible time when the Cont_1 signal 17' is selected by one of the printing element controllers 15. Shorter timing signals of equal length are provided on the Cont_2 line 18 and Cont_3 line 19. A still shorter timing signal is provided on the Cont_4 line 20 and a shorter still timing signal is provided on the Cont_5 line 21. In one embodiment the Cont_1 signal 1 17' has a duration of 0.289 ms, while the Cont_5 signal has a duration of 0.126ms.

While the incorporation of the techniques described above with reference to FIG. 4A-4E in thermal printheads allows for improved print quality, further improvements may be implemented so as to ensure that high quality print can be achieved in all printing circumstances. For example, the duration of the signals 17'-21' for a printing operation may be adjusted based upon energisations of the various ones of the printing elements in previous printing operations, as described in our earlier patent application PCT/GB2014/053105, the contents of which are herein incorporated by reference.

Reference has been made in the preceding description to continuous timing signals (as shown in FIG. 3). It will be appreciated that in alternative implementations pulsed timing signals may be used where the total duration of a plurality of pulses cause energisation of the printing elements for a particular desired time.

In an embodiment pulsed timing signals may be used to allow the energy delivered to a printing element to be distributed within a printing operation (i.e. a particular printing element may be energised for particular periods of time during a printing operation, the particular periods of time being separated by periods of time for which the printing element is not energised). It has been realised that this may have a particular benefit where the rate of movement between the substrate and the printhead is slow. For example where the substrate speed in the direction of printing is below 40 mm/s it has been observed that the printing using a conventional single continuous timing signal (as shown in FIG. 3), can result in 'burn-through'. That is, during slow speed printing, the relatively slow speed of the substrate and ribbon past the printhead, results in a significant amount of energy being dissipated into a small region of ribbon (i.e. each single line of a printed image), and possibly that small region of ribbon becoming melted or even destroyed.

Furthermore, where the timing signals which are only held high for a small portion of a full printing operation are driven only at the start of a printing operation, ink which was melted by the application of heat to the ribbon may in fact solidify prior to becoming separated from the ink ribbon, resulting in the ink ribbon becoming adhered to the substrate. That is, the slow speed of the substrate (and thus ribbon) transport results in there being sufficient time between the ink being heated and the ribbon and substrate separating that the ink has time to solidify. In order to prevent ink-solidification a printing element may be energised for a larger portion of the printing operation. However, this may well lead to burn-through as described above.

The use of flat printheads (where it is typically required that ink to be transferred should be allowed to solidify before the ribbon 2 passes a peel-off point) is particularly suited to slow speed printing. In such an arrangement an initial burst of thermal energy delivered to a printing element can cause ink to be melted and then to solidify prior to reaching the peel-off point. However, where a corner edge printhead is used, and ink is typically required to remain molten until the corresponding portion of ribbon reaches the peel-off point, the same is not true. That is, while the use of a corner edge printhead is particularly suited for high-speed printing (in which the duration for which the ink should remain molten is small), it presents challenges when performing printing at slower speeds. As described above, ink may need to be maintained in a molten form for an extended duration, which may require a significant amount of energy to be delivered to the printing elements, which can cause printing element burnout, or ink-ribbon burn-through.

Furthermore, it will be appreciated that during normal operation of a printer, as described above, it may be required for the substrate to change speed. For example, where printing is carried out at a print speed of 200 mm/s, and the substrate is caused to stop whilst printing an image, the speed of the substrate will decelerate from 200 mm/s to 0 mm/s in a finite period of time. It will further be appreciated that as a substrate is stopped it will, at times, be moving at all speeds between the initial speed (e.g. 200 mm/s) and zero. That is to say, the substrate will, at times, be travelling at speeds of less than 40 mm/s. Therefore, if printing is deactivated while the substrate speed is less than 40 mm/s (as is commonly the case in known printing methods) the substrate may have covered some appreciable distance during that slow speed period. For example, if a substrate decelerated from moving at 200 mm/s to being at rest in 0.1 seconds, with a constant deceleration rate (of 2000 mm/s$^2$), the substrate would move 10 mm whilst it was decelerating, of which 0.4 mm would be travelled while it was moving at a speed of less than 40 mm/s. Assuming a printing density of 12 dots/mm, then during the deceleration phase, 120 printing operations (i.e. 120 lines of printing) may be carried out (5 of which at a speed of less than 40 mm/s). That is, there would be 5 "missed" printing operations.

Further, after any such stoppage a substrate is also required to be accelerated up to the normal operational speed once more. If a similar acceleration profile is used to the above described deceleration, then a similar number of printing operations will be carried out during the acceleration phase as during the deceleration phase (i.e. 120 during acceleration, 5 of which below 40 mm/s).

It can be seen, therefore, that if printing is simply deactivated whilst the substrate is travelling below a speed of, for example, 40 mm/s, some images may be distorted either by having regions missing, or spaces between regions which should be adjacent. For example, where the printed image is a barcode, 10 missed printing operations could render the barcode un-readable. Moreover, even one or two missed lines within a barcode could result in printing failure. It will thus be appreciated that where the printing of such images is production critical (e.g. where the printing images relate to critical identification or safety information), products on which printing fails can be rejected. Therefore, by enabling printing at slow speeds, image quality can be improved, and production efficiency increased.

Figure 5A:
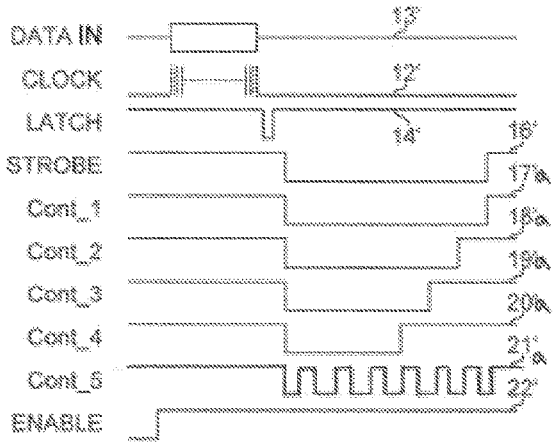
FIGS. 5A-5C are timing diagrams showing signals provided on the connections of FIG. 2D.
Figure 5B:
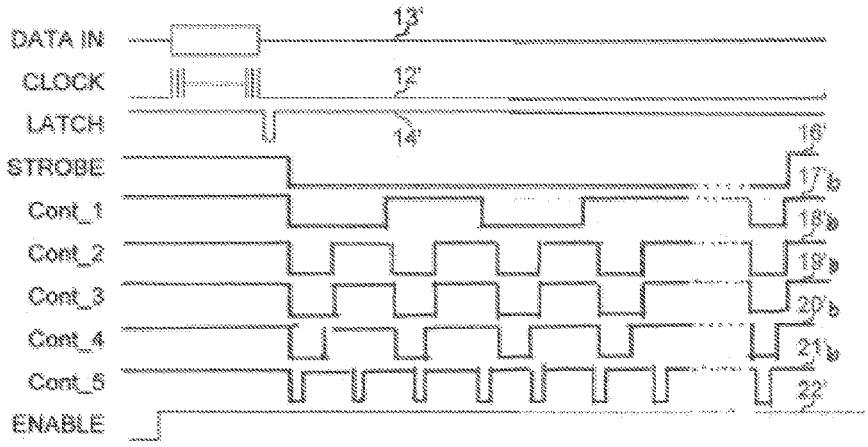
Figure 5C:
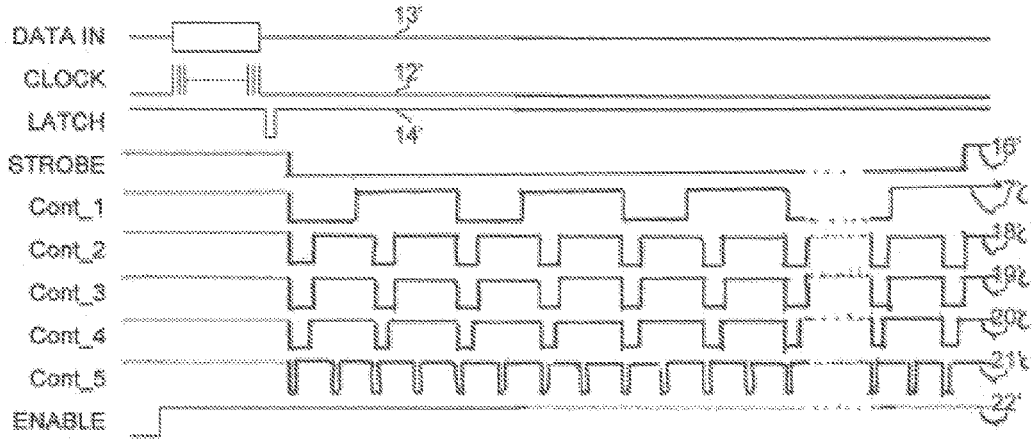

FIGS. 5A to 5C are timing diagrams showing pulsed timing signals provided on the various printhead connections shown in FIG. 2D by the printer controller 10 to effect printing at several different print speeds. The timing signals shown in FIGS. 5A to 5C differ from those described above with reference to FIG. 3 and are intended for use at different substrate (or print) speeds. The timing signals provided on the Cont_1 line 17, Cont_2 line 18, Cont_3 line 19, Cont_4 line 20, and Cont_5 line 21 are determined by the print speed, the timing signals being based on those shown in FIGS. 5A to 5C. FIG. 5A shows timing signals used for printing at a substrate speed of 200 mm/s. FIG. 5B shows timing signals used for printing at a substrate speed of 20 mm/s. FIG. 5C shows timing signals used for printing at a substrate speed of 10 mm/s.

In each of the FIGS. 5A to 5C, the clock signal 12', data 13', low latch signal 14', strobe signal 16' and enable signal 22' operate as described above with reference to FIG. 3. Their timing is not affected by the print speed (except that their duration is adjusted to extend for the duration of a printing operation). Also as described above, the duration of the energisation of each of the printing elements is controlled by the printing element controller 15 by selecting a respective one of five active-low timing signals 17'*a-c,* 18'*a-c,* 19'*a-c,* 20'*a-c,* 21'*a-c* (which are provided to Cont_1 line 17, Cont_2 line 18, Cont_3 line 19, Cont_4 line 20, and Cont_5 line 21 respectively). However, one or more of the five active-low timing signals may be pulsed, rather than having a single continuous strobe.

In the example shown in FIG. 5A (which provides timing signals intended for use at a print speed of 200 mm/s), each of the signals 17'*a*-20'*a* are continuous signals, each having a single continuous pulse. However, the signal 21'*a* comprises a plurality of pulses which are applied during a printing operation. Considering FIG. 3, it will be appreciated that the signal supplied to on Cont_5 line 21 is generally the one of the signals 17'-21' which has the shortest duration and is used to control printing elements which have been previously energised the most and are thus the hottest.

FIG. 5B shows timing signals intended for use at a print speed of 20 mm/s. The duration of the printing operation is extended when compared that that illustrated in FIG. 5A by virtue of the slower print speed. That is, at a print speed of 20 mm/s, the duration of each printing operation is significantly longer than when the print speed is 200 mm/s. However, the total duration of time for which printing elements are energised based upon the signals 17'*b*-21'*b,* as a fraction of the total duration of the printing operation, and hence strobe signal 16', is reduced with respect to higher speed printing operations (e.g. as shown in FIG. 5A). It will thus be appreciated that as the print speed is reduced, the signals 17'*b* to 21'*b* are only active (low) for a small fraction of the duration of the printing operation. As such, if all of the energy required to be delivered to the printing element was delivered within a short period of time, and not distributed throughout the printing operation, overheating may occur. However, rather than this being the case, each of the signals 17'*b* to 21'*b* comprises a plurality of pulses which are applied throughout the duration of the strobe signal 16'.

It can be seen that the signal 21'*b* is pulsed a greater number of times (and at a lower duty cycle) than the signals 17'*b* to 20'*b.* Further, the signals 18'*b*-20'*b* are pulsed a greater number of times (and at a lower duty cycle) than the signal 17'*b.* The energy delivered to each of the printing elements is thus distributed throughout the printing operation, with more energy being delivered by signals having a higher duty cycle.

As the print speed is further reduced, the pulsing of the printing control signals is further modified. For example, as shown in FIG. 5C, which shows timing signals applied at a print speed of 10 mm/s, the duration of the printing operation is further extended when compared that that illustrated in FIG. 5A. That is, at a print speed of 10 mm/s, the duration of each printing operation is significantly longer than when the print speed is 200 mm/s (or 20 mm/s). Each of the signals 17'*c*-21'*c* thus comprises a plurality of pulses spaced throughout the duration of the printing operation. Furthermore, each of the signals 17'*c*-21'*c* comprises a greater number of pulses, and with a reduced duty cycle, when compared to the corresponding signal as described above with reference to in FIG. 5B.

More generally, as the printing operation duration is increased (i.e. substrate speed is decreased), each of the signals is active for a smaller portion of the full operation duration. As such, pulsing is introduced first on the signals having the shortest duration, these signals being used to control heating elements which are most at risk of overheating. Those heating elements which are hottest, can be maintained at temperature by pulsing, so as to 'trickle' more energy into them, rather than by being driven for an extended duration to bring them up to temperature.

It will be appreciated that while the amount of energy required to melt a single dot of ink (i.e. which dot is required to be printed) is substantially constant, the energy delivered to a printing element may change at different print speeds. For example, the energy delivered to a printing element may change due to the effect of residual heat from other printing operations, and to heat lost through cooling during an extended printing operation. For example, latent heat stored within the printhead means that where several printing operations are carried out consecutively by a single printing element, or within a region of the printhead, less energy can be supplied for second and subsequent printing operations than is required for the first printing operation. Further, where high speed printing (i.e. high speed substrate and ribbon transport) is carried out, there is, in general, less time for each printing element to cool between each printing operation.

As such, a shorter printing element energisation duration may be required at a high speed when compared to a lower speed (where there may be significant cooling periods between energisations). It will be appreciated, however, that while the energy delivered to each printing element may change as a function of speed, it does not scale proportionally with the printing operation duration. The durations and pulsing requirements of the timing signals are optimised for each print speed, and may be obtained by the printer controller 10 from a look-up table during each printing operation.

During each of the printing operations for which a pulsed timing signal is applied, the number and duration of pulses are selected to deliver a predetermined total 'on' duration. That is, the duty cycle of the pulses is selected so as to ensure that the total 'on' duration provides sufficient energy to maintain the ink in a molten state for the required duration. The total 'on' duration may result in the same energy being delivered to a printing element as would be the case during a single continuous pulse. Alternatively, by distributing the energy throughout the printing operation, the total energy required may be reduced. For example, where it would be necessary to overheat the ribbon to account for cooling during the printing operation if a single pulse was used, it may be possible to reduce the total energy by pulsing the control signal. On the other hand, at very low speeds, it may be required to increase the total energy provided to a printing element so as to maintain the ink molten across an extended period of time.

In general, the number of pulses is selected in order to maintain the ink in a molten state while also not causing printing element burnout, or ink-ribbon burn-through. For example, the number of pulses may be varied between 1 and 1024.

Printing operation durations, pulse durations, and numbers of pulses which are may be used in each of the examples illustrated in FIG. 5 are summarised in Table 1. Additionally, parameters to enable printing at a substrate speed of 40 mm/s and 1 mm/s are also provided in Table 1. It should be noted that the timing signals illustrated in FIG. 5 are schematic, and are not intended to accurately represent the duration of the timing signals.

TABLE 1

Example printing control signal durations and pulse numbers

| Speed (mm/s) | Cycle duration (ms) | Cont1 duration (ms) | Cont1 pulses | Cont2/3 duration (ms) | Cont2/3 pulses | Cont4 duration (ms) | Cont4 pulses | Cont5 duration (ms) | Cont5 pulses |
|---|---|---|---|---|---|---|---|---|---|
| 200 | 0.417 | 0.181 | 1 | 0.089 | 1 | 0.083 | 1 | 0.056 | 8 |
| 40 | 1.667 | 0.270 | 1 | 0.202 | 1 | 0.221 | 1 | 0.176 | 31 |
| 20 | 4.167 | 0.675 | 3 | 0.540 | 12 | 0.473 | 12 | 0.326 | 32 |
| 10 | 8.333 | 0.773 | 8 | 0.734 | 24 | 0.734 | 24 | 0.578 | 64 |
| 1 | 83.33 | 3.750 | 72 | 3.563 | 216 | 3.563 | 216 | 2.375 | 576 |

It can be seen that as the speed is decreased, the duration of each of the signals increases (as does the duration of the total printing operation). Further, as the duration of each of the signals increases, the number of pulses which make up each of the signals is also increased, allowing the energy delivered to the printing elements to be distributed throughout the printing operation, rather than being delivered only during the first portion of the printing operation (which may be relatively long, at slow substrate speeds).

As each printing operation begins, the printing controller determines the various printing control signals required for that printing operation. In order to generate printing signals for the appropriate duration, the printer controller first determines the expected speed of the substrate during the subsequent printing operation and then then obtains predetermined control signal durations and pulse numbers with reference to a look-up table which is stored in a memory of the printer controller 10.

Different ones of the timing signals provided to the inputs 17 to 21 are pulsed in dependence upon the substrate speed. Further, different ones of the timing signals provided to the inputs 17 to 21 are pulsed for a different numbers of times, and for a different total duration within each printing operation in dependence upon the substrate speed. Where the determined substrate speed does not correspond to a substrate speed within the table, the printing control parameters are based upon the closest entries within the table. For example, the printing control parameters may be obtained by selecting the table entry immediately below the determined substrate speed, or by interpolating between the table entries corresponding to the speeds immediately above and below the determined substrate speed (as described in more detail below).

Figure 6:
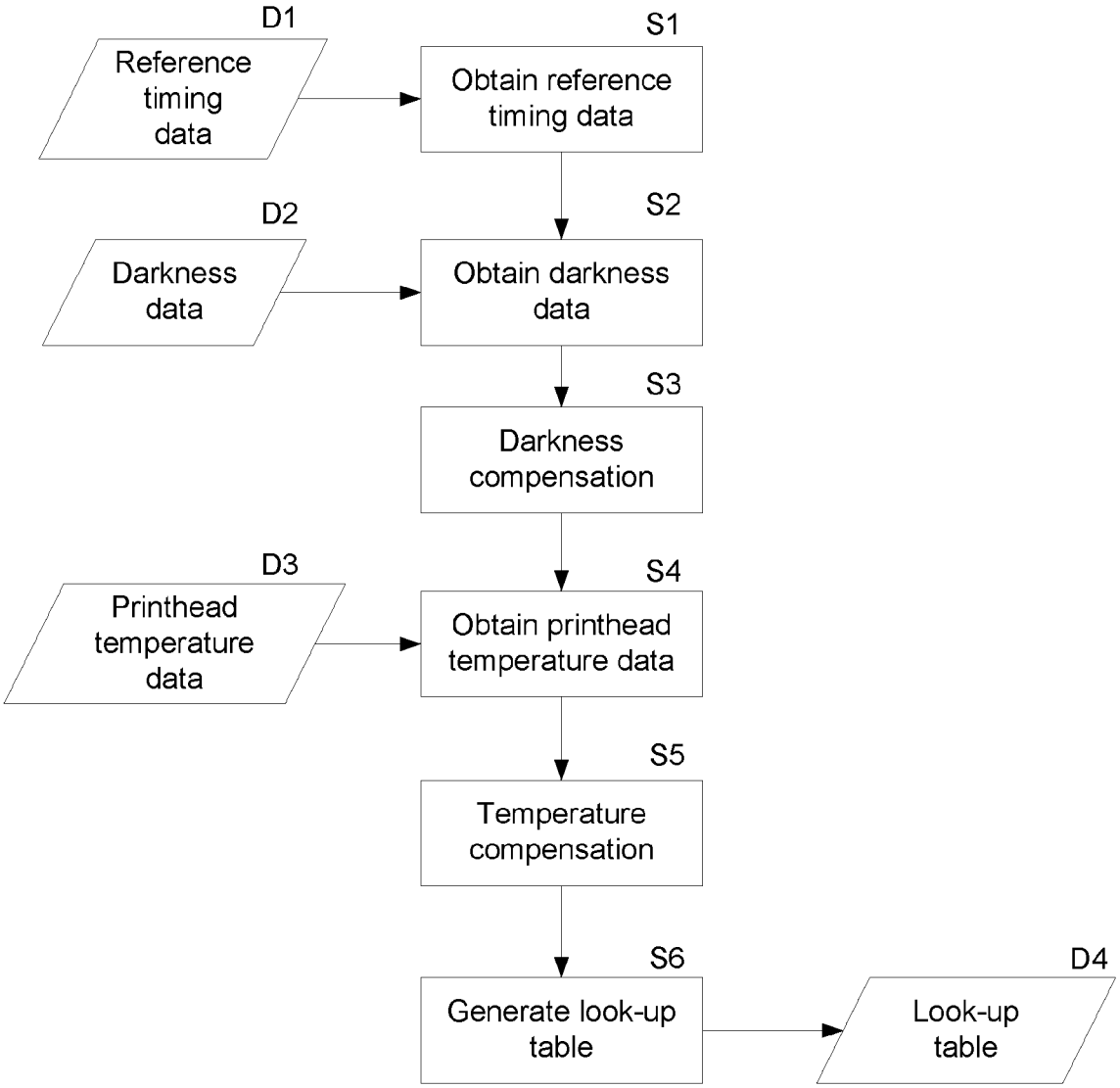
FIG. 6 is a flowchart showing processing carried out in a printer controller to generate the timing signals shown in FIG. 5.

Each of the predetermined control signal durations and pulse numbers within the look-up table are generated prior to a printing cycle commencing. FIG. 6 shows processing carried out by the controller 10 to generate the look-up table.

At step S1, reference timing data D1 is retrieved from a memory location associated with the controller 10. The reference timing data D1 may for example comprise a reference table in which entries are provided at convenient print speed intervals. For example entries may be provided at slow speeds at closer intervals than at higher speeds. That is, at slow speeds a fine degree of control over the timing of printing control signals is provided, while at higher speeds, such accuracy may not be necessary. For example, the reference table may contain entries which correspond to print speeds of 1, 2, 3, 4, 6, 8 and 10 mm/s, every 10 mm/s to 50 mm/s, and then every 50 mm/s.

The reference table entries for each speed comprise a printing operation duration, total durations for each of the timing signals 17' to 21' and data relating to the number of pulses for each of the timing signals 17' to 21'. The data relating to the number of pulses for each of the timing signals 17' to 21' may be a number of pulses to be used for that print speed.

The reference table entries for each speed comprise data relating to operation at a nominal print density (i.e. darkness) and a nominal temperature. For example, the nominal darkness may be 75%, and the nominal temperature 25° C.

Processing then passes to step S2 in which darkness data D2 is obtained by the controller 10 with reference to data stored within a memory associated with the controller 10. The darkness data D2 may, for example, be a darkness setting which defines a nominal darkness value between 0 and 100%. The darkness setting may, for example, have a value of 67%. The darkness setting may, for example, be determined on the basis of a type of ribbon which is being used, a type of substrate which is being used, or particular properties of the printer 1. It will be appreciated that some characteristics may have a more significant impact on the darkness setting than others. For example, the build quality of a particular printer may cause a variation of a few percent in the darkness setting, whereas a change between substrate types may cause a variation of a few tens of percent. For example, printing on vellum paper may be carried out with a darkness setting of 65%, while printing on a shiny gloss paper may be carried out with a darkness setting of 85%. On the other hand, differences in build quality result in darkness settings in otherwise similar printing configurations being varied between 65% and 67%. The darkness setting may, for example, be determined during a calibration or maintenance operation of the printer 1. Alternatively, or additionally, the darkness setting may be derived from a user defined parameter.

Processing then passes to step S3 in which the darkness data D2 is used to modify the reference data D1 so as to generate darkness compensated reference data. For example, timing signal duration values which within the reference data D1 may be scaled by a number in proportion to the darkness setting. It will be appreciated that such scaling may be linear or non-linear. Darkness scaling values may be determined by experimentation, and a relationship between desired darkness, and timing signal duration used to scale the timing signal durations.

Processing then passes to step S4 in which temperature data D3 is obtained by the controller 10. The temperature data may, for example, be obtained with reference to a thermocouple within the printhead 7.

Processing then passes to step S5 in which the temperature data D3 is used to modify the darkness compensated reference data so as to generate temperature (and darkness) compensated reference data. For example, timing signal duration values which within the darkness compensated reference data may be scaled by a number in proportion to the temperature. It will be appreciated that such scaling may be linear or non-linear. Temperature scaling values may be determined by experimentation, or may, for example, be provided by a printhead manufacturer. Nominal timing signal durations may, for example be scaled by 1% for each degree difference from the nominal temperature value. Alternatively, a relationship between printhead temperature and timing signal durations can be used to scale the timing signal durations. The printhead may have an operating range of, for example, between 0 and 65° C.

Processing then passes to step S6 where a look-up table D4 is generated from the temperature and darkness compensated reference data. The look-up table D4 is provided with entries at convenient print speed intervals, each of which comprises printing control signal parameters (such as, for example, printing operation duration, timing signal durations, timing signal pulse numbers). However, the look-up table D4 may contain greater or fewer entries than the reference data D1. For example entries may be provided at closer intervals than at in the reference data D1. For example, the look-up table D4 may contain entries which correspond to print speeds every 1 mm/s between 1 and 50 mm/s, and every 10 mm/s above 50 mm/s. The look-up table D4 may additionally contain an entry which corresponds to a print speed of 0.5 mm/s.

Thus it may be necessary to generate look-up table entries for intermediate reference data entries. The printing control signal parameters for such intermediate entries may be derived by interpolation on the basis of the closest entries in the reference table. For example, if entries are provided in the reference data for substrate speeds of 50 mm/s and 100 mm/s, an entry at a speed of 60 mm/s in the look-up table D4 may be generated based upon each of the entries for 50 mm/s and 100 mm/s in the reference table, scaled according to the required speed of 60 mm/s (i.e. 20% of the way between 50 mm/s and 100 mm/s). In this way, the printing control signal parameters within the look-up table D4 are generated on the basis of the temperature and darkness compensated reference data.

Both the timing signal durations, and the numbers of pulses may be scaled by interpolation as described above.

In some embodiments, however, the data relating to the number of pulses within the reference data D1 may be replaced by a maximum number of pulses, from which the actual number of pulses for a particular speed in the look-up table D4 can be derived by processing carried out at step S6. For example, in an embodiment, the number of pulses for the timing signal 21' is generated by dividing the duration of a printing operation by a nominal pulse period duration (e.g. 50 μs), and then modifying the resulting number of pulses if it does not comply with a set of predetermined rules. For example, the rules may state that the number of pulses should be at least 2, no greater than the maximum number of pulses specified for that print speed in the reference data D1, and also be an integer. It will be appreciated that different pulse number limits or nominal periods may be used, and that different, or additional ones of the timing signal pulse numbers may be derived in this way. Where such a derivation of the number of pulses is used, the maximum number of pulses may be scaled by interpolation as described above to generate an appropriate maximum number of pulses for a particular speed.

The processing described above with reference to FIG. 6 may be carried out periodically, and/or as necessitated by changes in printing configurations, or conditions (e.g. temperature). However, this processing is generally not carried out during a printing cycle (that is, during the printing of a single image), given that printing configurations or conditions are not expected to change to a significant extent during the printing of each image. Thus, when each printing cycle commences, the look-up table D4 contains appropriate timing signal parameters for that printing cycle. An appropriate look-up table entry is then retrieved for each printing operation within that printing cycle on the basis of the current substrate speed.

The substrate speed for each printing operation is thus used to determine the pulsing requirements for that printing operation. However, as described above, a substrate may accelerate or decelerate during the printing of an image. However where the substrate speed changes during the printing of an image it will be appreciated that the substrate speed will also change during each printing operation that makes up the printed image.

While it is described above that it is possible to select the pulsing requirements for a printing operation at the start of the printing operation, it has also been realised that where the substrate speed changing during a printing operation, print quality can be further improved by altering the printing control signals during each printing operation. That is to say, during acceleration or deceleration of a substrate, the pulsing requirements may change during a printing operation. In such cases, the printer controller 10 may determine an updated substrate speed during a printing operation, and generate updated printing control signals (i.e. a different number of pulses, having a different total duration) on the basis of the updated substrate speed multiple times during the printing operation.

Considering the example described above in which a substrate is decelerated from 200 mm/s to zero in 0.1 seconds, a printing operation which begins when the substrate is travelling at 200 mm/s would end when the substrate is travelling at approximately 199.16 mm/s. Such a change may not necessitate any update in printing control signals, the proportional change in speed during the printing operation being just 0.4%. However, a printing operation which begins when the substrate is travelling at 40 mm/s would end when the substrate is travelling at around 35.6 mm/s, a proportional change in speed during the printing operation of around 11%. Further, a printing operation which begins when the substrate is travelling at 20 mm/s would end when the substrate is travelling at around 8.2 mm/s, a proportional change in speed during the printing operation of around 60%.

It will be appreciated, therefore, that where printing is performed at slow substrate speed (i.e. a substrate speed of below 40 mm/s) significant differences between the substrate speed at the beginning and end of the printing operation can occur. Such changes result in the drive signals applied to the printing elements potentially being calculated on the basis of the wrong substrate speed, resulting in varied image darkness, or worse, a damaged ink ribbon or substrate surface.

As such, improved printing quality can be achieved by the printer controller determining an updated substrate speed during a printing operation, and generating updated printing control signals (i.e. timing signals of the type shown in FIGS. 5A to 5C) on the basis of the updated substrate speed multiple times during the printing operation.

Figure 7:
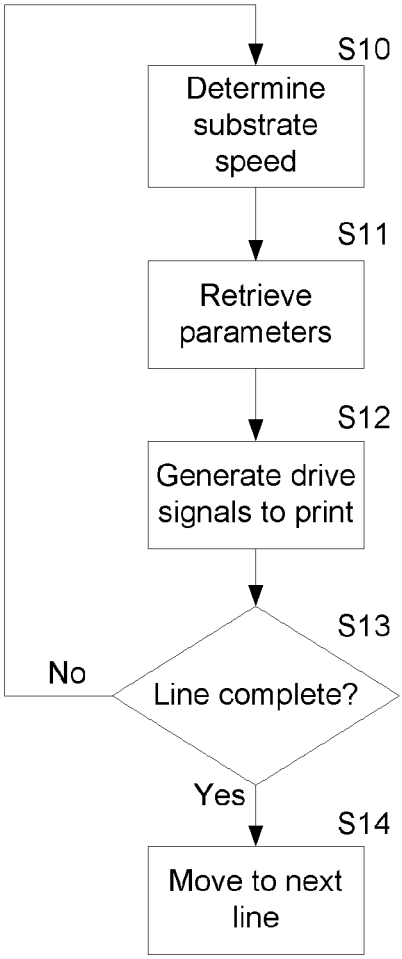
FIG. 7 is a flowchart showing processing carried out in a printer controller to generate the timing signals shown in FIGS. 5A to 5C.

FIG. 7 shows processing carried out by the controller 10 to generate the timing signals to be provided to the lines 17-21 and to update those timing signals based upon substrate speed updates during each printing operation. At step S10 the substrate speed is determined. The substrate speed may, for example, be determined with reference to an encoder (e.g. a rotary encoder) which is mounted on the substrate supply line.

Processing then passes to step S11, where printing control signal parameters which correspond to the determined substrate speed are retrieved from the look-up table D4.

Where the substrate speed does not exactly correspond to an entry in the look-up table D4, the closest entry below that substrate speed is used. Alternatively, the printing control parameters may be obtained by selecting the look-up table entry immediately above the determined substrate speed, or by interpolating between the table entries corresponding to the speeds immediately above and below the determined substrate speed.

Once printing control signal parameters have been determined, processing passes to step S12, where printing control signals are generated and applied to the printhead in a printing operation based upon the printing control signal parameters determined at step S11.

As printing continues, processing passes to step S13, where it is determined whether or not the printing operation (i.e. line of print) is complete. If so, processing passes to step S14 where the next line is prepared. However, if the printing operation is not complete, processing returns to step S10 where the substrate speed is once again determined. Steps S10 to S13 are thus repeated until the printing operation is complete.

While a printing operation is in underway, a counter is updated at each processor clock cycle. This allows the processor to monitor the duration of the printing operation, and to determine that the printing operation is complete when the counter has reached a predetermined value which corresponds to the number of clock cycles required for a printing operation having a predetermined cycle time. Where the substrate speed changed during a printing operation, the number of clock cycles required for that printing operation will be updated, and the counter value which corresponds to the number of clock cycles will also be updated (taking into account what fraction of the printing operation has already been carried out).

The various processes which occur during steps S10 to S13 take a finite (but possibly variable) time. For example, each repeat of the described process may take several hundred processor clock cycles. The duration of a printing operation (a single print-line) will also vary as a function of substrate speed. As such, the processing of step S10-S15 may be repeated a different number of times during each printing operation. For example, at a high print speed (e.g. 200 mm/s) the processing may be repeated approximately 100 times, whereas at a lower print speed (e.g. 20 mm/s) the processing may be repeated a greater number of times (e.g. thousands of times).

In addition to the processing described above to carry out printing on substrates moving at low speeds, it will be appreciated that below certain speeds, a substrate may be considered to be stationary. For example, a substrate which is moving at less than 1 mm/s may be considered to be stationary, and printing stopped accordingly.

In some embodiments, a printer may be arranged to print on a substrate which is a label, which is itself to be applied to a product on a production line, the labels generally being supplied at a rate to match the speed of the products on the production line, and being printed immediately in advance of their application (so-called print and apply labelling). Such a printing and labelling machine may be arranged to print at the speed demanded by the production line. However, where the speed of the production line falls below a minimum speed (e.g. 1 mm/s) the printing and label advance may be halted, with slack in a label (which may be partially adhered to a product on the production line) accommodating any possible creep of the product. Where a product moves beyond a predetermined amount at a speed below the minimum threshold speed, such as, for example 1-2 mm, the printing and labelling machine may advance by an equal amount so as to release any tension, before resuming a 'stationary' condition. During such an advance printing may be carried out on the substrate at a speed equal to or greater than the minimum threshold speed, and for a distance corresponding to the amount of the advance, so as to ensure that the printed image is not compromised.

Figure 8:
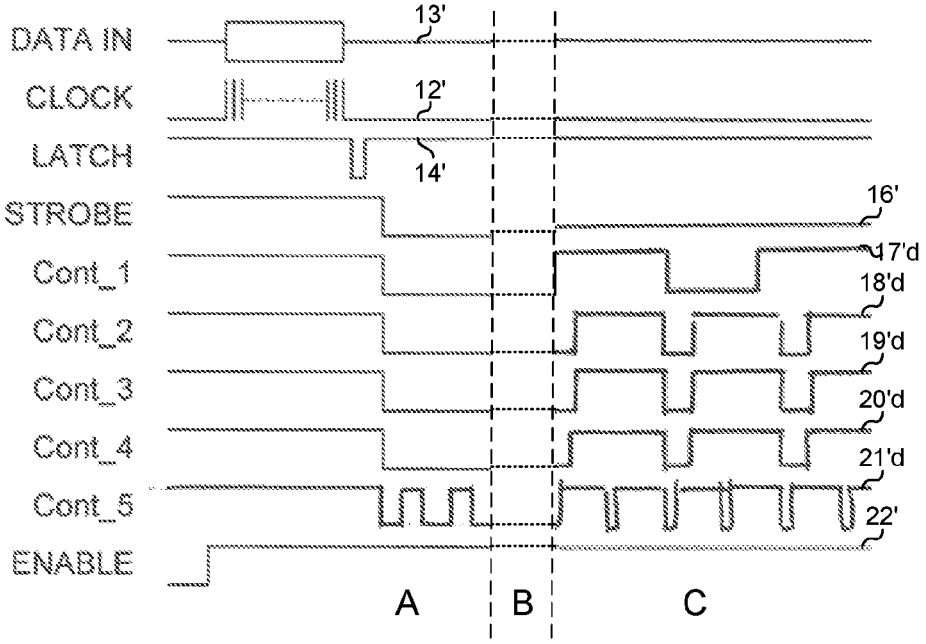
FIG. 8 is a timing diagram showing signals generated as a result of the processing of FIG. 7.

FIG. 8 is a timing diagram showing pulsed timing signals provided on the various printhead connections shown in FIG. 2D by the printer controller 10 to effect printing at a print speed which is updated during the printing operation. The printing operation is initiated when the print speed is 200 mm/s, as illustrated by a period A, and completes when the print speed is 20 mm/s, as illustrated by a period C. An intermediate period B may involve printing at a plurality of print speeds intermediate 200 and 20 mm/s. The clock signal 12', data 13', low latch signal 14', strobe signal 16' and enable signal 22' operate as described above with reference to FIGS. 3 and 5A to 5C. Also as described above, the duration of the energisation of each of the printing elements is controlled by the printing element controller 15 by selecting a respective one of five active-low timing signals 17'*d*, 18'*d*, 19'*d*, 20'*d*, 21'*d* (which are provided to Cont_1 line 17, Cont_2 line 18, Cont_3 line 19, Cont_4 line 20, and Cont_5 line 21 respectively).

However, the timing signals 17'*d*-21'*d* are adjusted during the printing operation, as a result of processing described above with reference to FIG. 7, so as to accommodate the change in print speed. It can be seen that each of the signals 17'*d*-20'*d* begins the printing operation (during period A, when the print speed is 200 mm/s) in a continuously active state, and concludes the printing operation (during period C, when the print speed is 20 mm/s) in a pulsed state. The pulse frequency of the signal 21'*d* is increased during the printing operation. It should be noted that the illustrated timing signals are schematic, and are not intended to accurately represent the duration of the timing signals.

In some embodiments (as described above) the substrate speed may be measured by use of a rotary encoder. Alternatively, the substrate speed may be determined with reference to an encoder on the ribbon path (the ribbon being controlled to move at substantially the same speed as the substrate). In a further alternative, the substrate speed may be determined with reference to a substrate transport control signal or any form of a substrate speed sensor.

The output of any such encoder or sensor may be processed in some way in advance of being used as an input to the processing described in step S10. For example, the encoder output may be averaged, so as to smooth any instantaneous fluctuations in the encoder output. Further, the averaging period may be varied depending on the particular usage scenario. For example, where the substrate is moving in a steady state condition a slow average (i.e. taking an average of many encoder output values) may be used. This allows an accurate speed measurement to be made, reducing or eliminating noise which can result from the use of discrete sensor readings. On the other hand, when the substrate is accelerating or decelerating, or moving extremely slowly, a fast average may be used (i.e. taking an average of a small number of encoder output values). Such a fast average allows an instantaneous speed to determined, albeit with a degree of noise.

In general it will be appreciated that the generation of pulsed printing control signals based upon substrate speed may be implemented independently of the modification of the duration of printing control signals based upon the printing history.

Further, it will be appreciated that in some embodiments printheads may not comprise control logic which selects between a plurality of timing signals on the basis of printing element energisations in previous printing operations. As such, a single timing signal may be supplied to such a printhead. Such a single timing signal may be pulsed as described above so as to distribute the energy delivered to printing elements.

Further still, where no such account of printing history is made, a printing operation may be divided into a plurality of sub-printing operations, in which subsets of the printing elements which are required to be energised in the printing operation are energised in the each of the respective sub-printing operations. In that way, printing elements which have been recently energised (i.e. are still hot) may be energised for only some of the plurality of sub-printing operations, while printing elements which have been not recently energised (as much) may be energised for all (or more) of the plurality of sub-printing operations. Sub-printing operations as described above need not each have an equal duration.

In an embodiment, a printing operation may be sub-divided into three such sub-printing operations each having a duration equal to one third of the printing operation duration. Processing performed by the controller 10 may determine which of the printing elements are to be energised in each of the three sub-printing operations, and generate different print data to be provided to the data line of the printhead during each of the sub-printing operations. It will further be appreciated that in such an arrangement the timing signal may be pulsed a number of times, and for a total duration, based upon the sub-printing operation duration.

It will be appreciated that printing operations are not necessarily controlled directly based upon the substrate speed. For example, in many printing techniques, printing operations are controlled based upon the ribbon speed (which may be controlled to be the same as the substrate speed). However, in some printing techniques, the ribbon and substrate are moved at different speeds. For example, the ribbon speed may be a scaled version of the substrate speed. Further, in some printing techniques, printing operations are controlled in such a way that they are not directly based upon either of the substrate speed or the ribbon speed.

As described above, durations of printing control signals are stored within the look-up table D4 for each print speed. Alternatively, percentages of a printing operation duration for which the timing signals 17'-21' are driven on (and hence the percentages of a printing operation for which printing elements are to be energised) may be stored, allowing any modification of the printing operation duration (e.g. as a result of a change in speed) to effect changes in the duration of all of the timing signals 17'-21'. Such an arrangement may allow finer control of printing operations, by ensuring that speed changes mid-print do not result in over-, or under-driving of printing elements, as printing elements will be driven for a predetermined percentage of a printing operation duration, rather than for a predetermined period of time.

Further, where printing timing signal duration control is additionally based upon print history, a nominal duration value may be modified first based upon the printing history, and then secondly based upon the substrate speed (as described above with reference to FIGS. 6 and 7), or vice versa.

Furthermore, printing control signals may be generated and updated during a printing operation (as described above with reference to FIG. 7) independently of, or in combination with, either or both of the printing history and pulsed printing control signal control schemes described further above.

Further still, where printing is stopped for a period of time, the printing elements which had recently been energised for printing will cool. However, the processing described above with reference to FIG. 4A to 4E may not take into account any delay between adjacent (i.e. subsequent) printing operations. As such, even when a printing element is cool, having been inactive for a period of time (i.e. while printing was suspended), logic within the printhead may seek to apply a shorter energisation signal to the printing element on the basis of its energisation in an earlier printing operation. This may have the effect of causing printing elements to be under-powered in printing operations which immediately follow a temporary suspension of printing operations.

This problem can be overcome by generating printing control signals to drive each of the inputs 17 to 21 which are identical in the first printing operation after a temporary suspension of printing operations. This ensures that regardless of the printing status of each printing element in the printing operation immediately before the suspension of printing operations, each printing element which is to be energised is energised for a duration which reflects the fact that the printing elements has been allowed to cool.

Further, in the a second printing operation after a temporary suspension of printing operations the printing control signal 17 may be provided with a full length printing control signal, while each of the inputs to 18 to 21 may be provided with an identical printing control signal which would ordinarily be provided to the input 20 (i.e. Cont 4) (so as to ensure that printing elements which were energised in operations prior to the temporary suspension are provided with lengthened energisation signals).

Thus where processing carried out within a printhead controller takes into account printing element energisations in two previous printing operations, normal printing signal durations resume after two printing operations. Of course, it will be appreciated that where a different number of previous printing operations are taken in to account, normal printing signal durations may resume in a different number of printing operations. Where no such processing is carried out within a printhead controller to take into account printing element energisations in previous printing operations, normal printing signal durations resume immediately after the resumption of printing (and no account need be taken of any previous printing operations by the controller).

Reference has been made above to the concept of print speed, being the speed of relative movement between the printhead and the substrate. This has, in some examples, been equated to substrate speed. This applies when printing is effected by a stationary printhead, past which ribbon and substrate are moved (so-called "continuous" printing). However the various techniques described herein apply equally when the substrate and ribbon are held stationary and the printhead is moved relative to the stationary substrate and ribbon (so-called "intermittent" printing). Here print speed is defined by the speed of movement of the printhead relative to the stationary ribbon and substrate.

Reference has been made in the preceding description to a data signal 13' being provided to the data line 13. It will be appreciated that in some embodiments there are provided a plurality of data lines which are provided with a plurality of data signals. For example, a first data line may be provided with data for driving printing elements 1-640, while a second data line may be provided with data for driving printing elements 641-1280. The first and second data lines may be provided parallel to one another, allowing data to be loaded to two shift registers, each corresponding to 640 printing elements, simultaneously.

Reference has been made in the preceding description to the printer controller 10 and various functions have been attributed to the printer controller 10. It will be appreciated that the printer controller 10 can be implemented in any convenient way including as an application specific integrated circuit (ASIC), field programmable gate array (FPGA) or a microprocessor connected to a memory storing processor readable instructions, the instructions being arranged to control the printer and the microprocessor being arranged to read and execute the instructions stored in the memory. Furthermore, it will be appreciated that in some embodiments the printer controller 10 may be provided by a plurality of controller devices each of which is charged with carrying out some of the control functions attributed to the printer controller 10.

In some embodiments, rather than the number of pulses within a printing operation being varied based upon the printing speed, the duration of pulses may be varied while the number of pulses remains at a predetermined number. During each of the printing operations for which a pulsed timing signal is applied, the duration of pulses are selected to deliver a predetermined total 'on' duration. That is, the duty cycle of the predetermined number of pulses may be selected so as to ensure that the total 'on' duration provides sufficient energy to maintain the ink in a molten state for the required duration. The total 'on' duration may result in the same energy being delivered to a printing element as would be the case during a single continuous pulse. As described above, the use of a plurality of pulses allows the ink to be maintained in a molten state by distributing the energy delivered throughout the printing operation, while the adjustment made to the duration of each pulse reduces the possibility of printing element burnout, or ink-ribbon burn-through. It will be appreciated that different ones of the printing control signals may be provided with different predetermined numbers of pulses.

Further, the predetermined number of pulses may change based upon the printing speed. For example, at a first range of speeds a first predetermined number of pulses may be used (the duration of which is further varied based upon the speed), whereas at a second range of speeds a second predetermined number of pulses may be used (the duration of which is further varied based upon the speed).

It will be appreciated that in some embodiments both the number and duration of pulses within a printing operation are varied.

In some embodiments, a printing control signal may comprise a first portion, in which the number of pulses is fixed (e.g. a single pulse), and further comprise a second portion in which the number of pulses is varied based upon speed. In such an embodiment, the duration of pulses in the second portion are selected to deliver a predetermined total 'on' duration when combined with the first portion. More generally, a printing control signal may comprise some portions which are modified based upon the print speed and some portions which are not modified based upon the print speed. Further, a printing control signal may comprise a predetermined pattern of pulses, the duration of some of which are modified based upon print speed, while others are not modified based upon print speed.

Further, in some embodiments, a printing control signal may be modified during a printing operation such that no additional energy is required to be delivered to the printing elements in a further portion of the printing operation. For example, where a change of print speed occurs during a printing operation and it is determined that during a first portion of that printing operation the energy delivered to the printing elements is equal to or exceeds the required energy for the entire printing operation, in the second (or remaining) portion of the printing operation there number of pulses may be set to zero, such that no further printing element energisations occur. That is, where there is a risk that the printing energy will over-shoot the energy required for a particular printing speed, the printing control signal may be truncated.

On the other hand, in some circumstances, for example where a print speed is updated during a printing operation, the present number of printing element pulses may not correspond to an updated printing operation duration. As such, the controller may be configured to maintain the present pulse rate and duration until an update to the printing control signal is performed. That is, the update rate for the printing control signal may be such that the controller does not immediately respond to a change in print speed.

While various embodiments have been described above it will be appreciated that these embodiments are for all purposes exemplary, not limiting. Various modifications can be made to the described embodiments without departing from the spirit and scope of the present invention.

The invention claimed is:

1. A method of operating a thermal transfer printer, the thermal transfer printer comprising: first and second spool supports each being configured to support a spool of ribbon;

a ribbon drive configured to cause movement of ribbon from the first spool support to the second spool support along a predetermined ribbon path; and a printhead, the printhead being a corner edge printhead, and being configured to selectively transfer ink from the ribbon to a substrate as the substrate and printhead are moved relative to one another at a print speed;

the method comprising transferring ink from the ribbon to the substrate when the print speed is less than 40 millimetres per second.

2. A method according to claim 1 wherein the method comprises:

generating a printing control signal for controlling the printhead, the printing control signal comprising one or more timing signals controlling one or more times for which one or more printing elements are energised in a printing operation.

3. A method according to claim 2, wherein generating a first one of the one or more timing signals comprises generating a number of pulses, the number being greater than or equal to one, and wherein the total duration of said pulses defines a time for which said one or more printing elements are energised; and wherein the number of pulses and/or the length of at least some of the or each pulse is based upon the print speed.

4. A method according to claim 1 wherein the method comprises:

obtaining the print speed during a printing operation;

generating a printing control signal for controlling the printhead, the printing control signal comprising one or more timing signals controlling one or more times for which one or more printing elements are energised in said printing operation based upon the print speed;

obtaining an updated print speed during said printing operation;

generating a further printing control signal for controlling the printhead, the further printing control signal comprising one or more timing signals controlling one or more times for which one or more printing elements are energised in said printing operation based upon the updated print speed.

* * * * *